US005975883A

United States Patent [19]

Carbone et al.

[11] Patent Number: 5,975,883

[45] Date of Patent: Nov. 2, 1999

[54] METHOD AND APPARATUS FOR REDUCING EMISSIONS IN COMBUSTION PRODUCTS

[75] Inventors: Philip C. Carbone, North Reading; Judith E. Reich, Andover; Karen R. Benedek, Winchester, all of Mass.

[73] Assignee: Gas Research Institute, Chicago, Ill.

[21] Appl. No.: 09/020,569

[22] Filed: Jan. 23, 1998

[51] Int. Cl.[6] ..... F24C 5/00

[52] U.S. Cl. ..... 431/8; 431/351; 431/353; 126/91 A; 126/110 R; 126/116 R

[58] Field of Search ..... 431/8–10, 350–354, 431/178, 284, 182, 174; 126/116 R, 110 R, 91 A, 99 R

[56] References Cited

U.S. PATENT DOCUMENTS

| | | | |
|---|---|---|---|
| 3,807,940 | 4/1974 | Juricek | 431/351 |
| 4,105,395 | 8/1978 | Goodnight et al. | 431/351 |
| 4,474,551 | 10/1984 | Iwai et al. | 431/354 |
| 4,476,850 | 10/1984 | Pickering . | |
| 5,156,542 | 10/1992 | Hannen et al. | 431/353 |
| 5,238,396 | 8/1993 | Yap | 431/351 |
| 5,244,381 | 9/1993 | Cahlik . | |
| 5,322,050 | 6/1994 | Lu . | |
| 5,370,529 | 12/1994 | Lu et al. . | |
| 5,406,933 | 4/1995 | Lu . | |
| 5,458,484 | 10/1995 | Ripka . | |
| 5,472,339 | 12/1995 | Rakowski et al. . | |
| 5,546,925 | 8/1996 | Knight et al. . | |
| 5,597,301 | 1/1997 | Roy et al. . | |

*Primary Examiner*—James C. Yeung
*Attorney, Agent, or Firm*—Pauley Petersen Kinne & Fejer

[57] ABSTRACT

A method and apparatus for reducing emissions in combustion products. Fuel and primary oxidant are introduced into a burner tube and discharged as a fuel/oxidant mixture, preferably fuel-rich, into a primary combustion chamber. The combustion flame entrains, through a peripheral gap between the burner tube and a wall of a first housing, a first portion of secondary oxidant in the primary combustion chamber. The combustion flame is then directed, preferably through a swaged orifice, into a secondary combustion chamber. Within the secondary combustion chamber, the combustion flame entrains a second portion of secondary oxidant and then combustion products are discharged through an exhaust tube.

21 Claims, 3 Drawing Sheets

METHOD AND APPARATUS FOR REDUCING EMISSIONS IN COMBUSTION PRODUCTS

BACKGROUND OF THE INVENTION

1. Field of the Invention

This invention relates to a method and apparatus for reducing emissions in combustion products resulting from a two-stage continuous combustion process.

2. Description of Prior Art

Many conventional combustion processes use staged combustion wherein fuel and primary air are introduced into a primary combustion chamber to form a fuel-rich mixture and secondary air is introduced in a secondary combustion zone. For example, U.S. Pat. No. 5,472,339 discloses a baffle member which divides a combustion chamber into first and second regions. A fuel-rich mixture of gas and primary air is injected through an inshot burner and a combustion flame is drawn into the combustion chamber by an induced draft blower which also introduces secondary combustion air. The baffle member channels the flame and secondary combustion air into a convergent flow path and over the baffle member to create turbulence, which enhances mixing between the fuel-rich flame and secondary combustion air within the second region of the combustion chamber, which is downstream with respect to the baffle member.

U.S. Pat. No. 5,244,381 discloses an inshot burner mounted within a central opening that allows secondary air to pass into the combustion chamber. The secondary air is directed by a frustro-conical member into the combustion zone for enhancing the combustion process. The frustro-conical member spans from an upstream side of an exit plane of the inshot burner to a downstream side of the exit plane. A target plate is positioned near the discharge end of the inshot burner. The target plate transfers heat from the flame to rods affixed to a face of the target plate.

U.S. Pat. No. 5,597,301 discloses a burner emission device that includes a stack of perforate metal sheets positioned in a flow path of a flame, which enhances turbulence.

It is apparent from the known conventional technology that there is a need for a two-stage burner apparatus and method which reduces nitrogen oxides and which can be retrofitted into many existing burner devices.

SUMMARY OF THE INVENTION

It is one object of this invention to provide a method and apparatus that introduces a fuel-rich combustion flame into a primary combustion chamber.

It is another object of this invention to provide a method and apparatus that draws a relatively small amount of secondary oxidant into a fuel-rich flame within a primary combustion chamber.

It is another object of this invention to provide a method and apparatus that passes a fuel-rich combustion flame with a relatively small amount of secondary oxidant through a swaged orifice and into a secondary combustion chamber.

It is another object of this invention to introduce secondary oxidant within a secondary chamber.

It is still another object of this invention to discharge a combustion flame from a secondary combustion chamber through an exhaust tube or heat exchange device.

The above and other objects of this invention are accomplished with a method and apparatus which reduces emissions and combustion noise in a gas-fired combustion system that preferably but not necessarily uses inshot burners. Fuel enters an inlet of a burner and entrains a relatively small amount of oxidant to produce a fuel-rich mixture at an exit plane of the burner tube. The burner tube is mounted within an opening 42 in a wall of a first housing that forms a primary combustion chamber. The exit plane of the burner tube is preferably positioned at a distance from the wall of the primary housing.

The burner tube is preferably mounted within the opening 42 of the first wall of the first housing so that a peripheral opening is formed about an outer surface of the burner tube. In one preferred embodiment according to this invention, the peripheral opening completely surrounds the burner tube. A relatively small amount of secondary air flows through the peripheral opening, into the primary combustion chamber and is entrained within the fuel-rich combustion flame. After the secondary air is introduced into the fuel-rich combustion flame which is established or anchored at an exit plane of the burner tube, the combustion flame is discharged through an orifice within a second wall of a second housing that forms a secondary combustion chamber.

In one preferred embodiment according to this invention, the orifice is a swaged orifice and the combustion flame passes through the swaged orifice, preferably without touching the second wall, into the secondary combustion chamber. A relatively larger amount of secondary air is entrained into the combustion flame within the secondary combustion chamber. The combustion flame then flows through an exhaust tube which is in communication with the secondary combustion chamber.

With the method and apparatus according to this invention, the fuel-rich combustion with the downstream staged addition of secondary air limits the production of nitrogen oxides ($NO_x$) with a relatively rich-burn, heat loss, combustion completion technique. Because the primary combustion chamber operates with a relatively fuel-rich environment, relatively little $NO_x$ is produced. The combustion flame is stabilized at the exit plane of the burner tube by entrainment of the secondary oxidant passing through the peripheral opening surrounding the burner tube. The combustion gases are then mixed with additional air in a secondary combustion zone. The combustion flame is controlled and directed into a heat exchanger tube by additional secondary air forming a sheath around the combustion flame.

Because much of combustion noise normally present in gas-fired furnaces is due to combustion flame instabilities, the method and apparatus of this invention also produces a quieter operating system. Recirculation around the exit plane of the burner tube tends to maintain the combustion flame in an attached or anchored position with respect to a flame holder, while a smooth entrance of the combustion flame into the exhaust tube helps prevent flame impingement, which might produce additional acoustic emissions.

Also according to this invention, carbon monoxide (CO) is reduced because the combustion flame preferably does not impinge upon the exhaust tube walls and thus quench before achieving sufficient residence time to burn out the CO. Operating temperatures of the method and apparatus according to this invention are relatively low because the secondary oxidant forms a jacket around the combustion flame in the secondary combustion chamber, which helps prevent the combustion flame from attaching on the wall of the second housing, at an edge of the swaged orifice.

DESCRIPTION OF PREFERRED EMBODIMENTS

As used throughout this specification and in the claims, the terms air and oxidant are intended to be interchangeable. It is apparent that the process of combustion according to this invention can operate with air, oxygen-enriched air, oxygen or any other suitable oxidant. The term fuel as used throughout this specification and in the claims relates to any suitable gaseous fuel, atomized fuel, gasified fuel or any other suitable type of fuel. Natural gas and other gaseous fuels are preferred but not necessary for operation with the low $NO_x$ combustion apparatus and process according to this invention.

Figure 1:
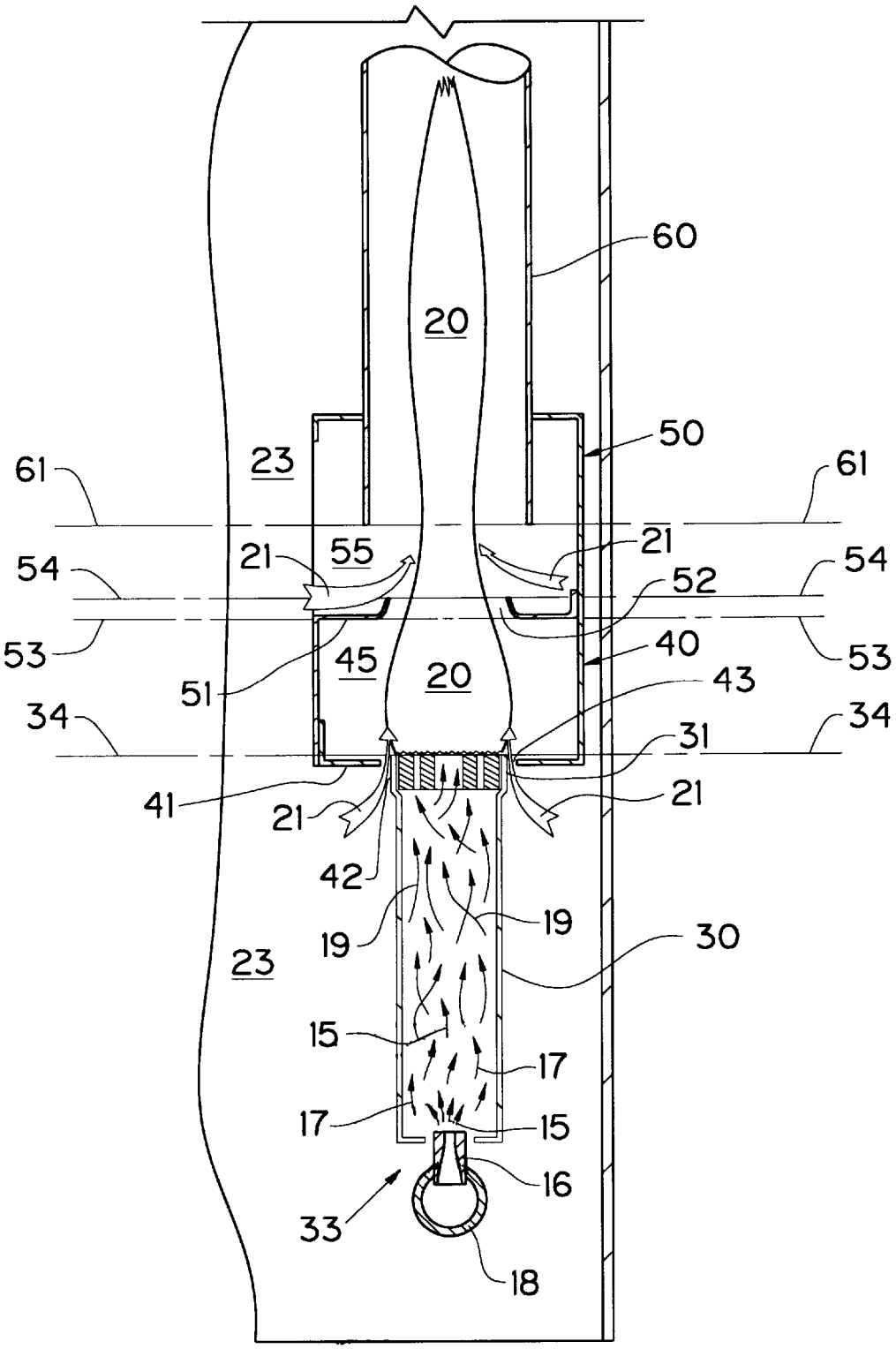
FIG. 1 is a partial cross-sectional view taken along a longitudinal axis of a burner tube and an exhaust tube of a burner apparatus according to one preferred embodiment of this invention.
Figure 2:
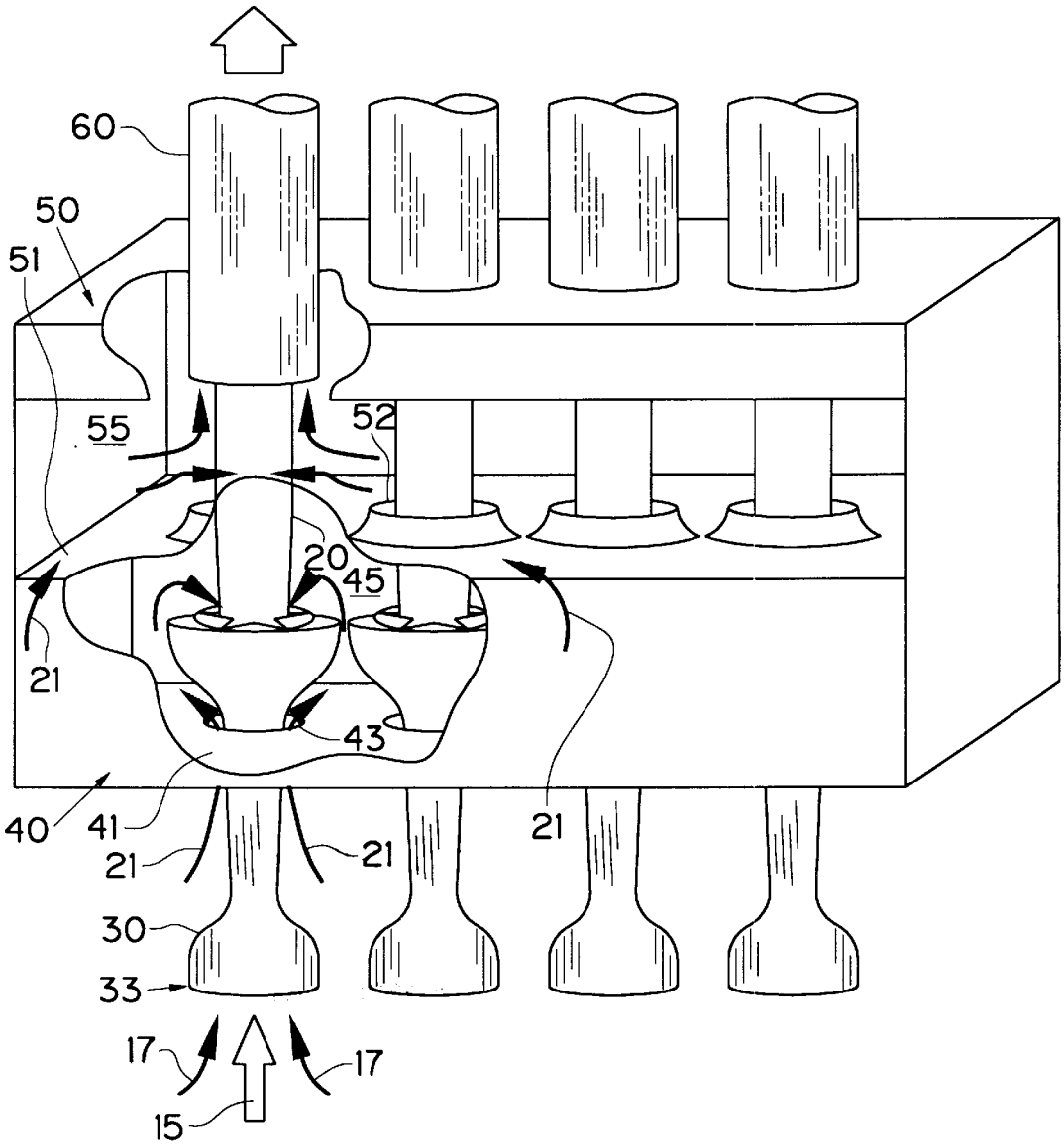
FIG. 2 is a schematic perspective view of a burner apparatus, showing a cutout section exposing a primary combustion chamber formed by a primary housing, according to one preferred embodiment of this invention.

In one preferred embodiment according to this invention, a method for reducing emissions and combustion products during a continuous combustion process begins with introducing fuel 15 and primary air 17 into inlet portion 33 of burner tube 30, as shown in FIGS. 1 and 2. In one preferred embodiment according to this invention, burner tube 30 comprises a converging-diverging nozzle, such as shown in FIG. 2. In another preferred embodiment according to this invention, burner tube 30 comprises an inshot burner device, such as shown in FIG. 1. However, it is apparent that any other suitable burner device that sufficiently mixes fuel 15 and primary air 17 can be used in place of or in addition to burner tube 30, as shown in FIG. 1 or FIG. 2. Preferably, burner tube 30 thoroughly mixes fuel 15 and primary air 17 in proportional flow rates so that fuel/air mixture 19 at exit plane 34 of burner tube 30 is a fuel-rich mixture.

As used throughout this specification and in the claims, a fuel-rich fuel/air mixture 19 is intended to relate to fuel/air mixture 19 having excess fuel which cannot be burned in a particular environment. For example, in one preferred embodiment according to this invention, fuel/air mixture 19 has excess fuel 15 within primary combustion chamber 45, such that there is incomplete burning for combustion of the entire amount of fuel 15 within primary combustion chamber 45.

As used throughout the specification and in the claims, the term downstream is intended to relate to a direction that the combustion flame flows, such as from exit plane 34 of burner tube 30 to second opening 52.

Although not shown in the drawings, a suitable ignition source is mounted at, within or near primary combustion chamber 45. The ignition source ignites fuel/air mixture 19 at or downstream of exit plane 34 of burner tube 30. In one preferred embodiment according to this invention, combustion flame 20 anchors at or shortly downstream of exit plane 34. It is apparent that the shape and/or other characteristics of combustion flame 20 can be varied by adjusting several different parameters, including the flow rate of fuel 15, the flow rate of primary air 17 and/or the flow rate and/or direction at which secondary air 21 is introduced into primary combustion chamber 45, such as shown in FIGS. 1 and 2 and discussed later in this specification As shown in FIGS. 1 and 2, a first flow rate of secondary air 21 passes through peripheral gap 43 which is located between outer surface 31 of burner tube 30 and first opening 42 of first wall 41 of first housing 40. The fluid dynamic and aerodynamic characteristics of combustion flame 20 preferably draw or entrain the first flow rate of secondary air 21 into combustion flame 20, within primary combustion chamber 45. The first flow rate of secondary air 21 mixes with combustion flame 20 within primary combustion chamber 45 and stabilizes the relatively fuel-rich fuel/air mixture 19 around a discharge of burner tube 30.

As shown in FIG. 1, combustion flame 20 is then directed through second opening 52. In one preferred embodiment according to this invention, second opening 52 comprises a swaged orifice, such as shown in FIG. 1 and having inlet plane 53 and exit plane 54. The swaged orifice can either be formed by second wall 51 of second housing 50 or can comprise a separate plate or other component mounted with respect to second wall 51. The swaged opening converges in the downstream direction, as shown in FIG. 1. In other preferred embodiments according to this invention, second opening 52 may comprise any other suitable orifice plate or other suitable structure with a void that accommodates combustion flame 20.

In one preferred embodiment according to this invention, wherein second opening 52 comprises a swaged orifice, combustion flame 20 is prevented from attaching at edges of second wall 51 that define second opening 52, such as shown in FIG. 1. Operating temperatures of hardware associated with the apparatus of this invention are minimized by preventing combustion flame 20 from attaching to such edges of second wall 51 that define second opening 52.

Combustion flame 20 is then discharged through exit plane 54 of second opening 52 and into secondary combustion chamber 55. As shown in FIGS. 1 and 2, second housing 50 forms secondary combustion chamber 55 which is in communication with a secondary oxidant supply 23. The secondary oxidant supply may comprise, as shown in FIG. 2, a wall of second housing 50 which has a substantial opening that communicates with an environment or ambient surrounding at least one of first housing 40 and/or second housing 50.

As combustion flame 20 passes through secondary combustion chamber 55, combustion flame 20 entrains or draws a second flow rate of secondary air 21 into combustion flame 20, within secondary combustion chamber 55. In one preferred embodiment according to this invention, as shown in FIG. 1, combustion chamber 55 extends into exhaust tube 60 and combustion may occur within exhaust tube 60. The additional secondary air 21 further dilutes the fuel-rich fuel/air mixture 19 and thereby burns additional fuel 15. In one preferred embodiment according to this invention, there is sufficient secondary air within the first flow rate directed into primary combustion chamber 45 and within the second flow rate directed into secondary combustion chamber 55, in order to burn or combust all of fuel 15. As used throughout this specification and in the claims, all or complete burnout of fuel 15 is intended to relate to either 100% burnout of fuel 15 or substantial burnout of fuel 15, such as within tolerable limits of unburned fuel as known to those skilled in the art of combustion.

In one preferred embodiment according to this invention, a ratio of the first flow rate of secondary air 21 introduced into primary combustion chamber 45 divided by the second flow rate of secondary air 21 introduced into secondary combustion chamber 55 is less than 1.0. In another preferred embodiment according to this invention, such ratio is in the range of approximately 0.01 to approximately 0.20. In one preferred embodiment, the fluid dynamics and aerodynamics associated with combustion flame 20 are responsible for discharging all combustion products from secondary combustion chamber 55, through exhaust tube 60, as shown in FIG. 2.

In one preferred embodiment according to this invention, peripheral gap 43 can be designed and adjusted to vary the first flow rate of secondary air 21. For example, an area, cross-sectional shape or any other suitable parameter of peripheral gap 43 can be designed or adjusted to introduce more or less secondary air 21 into primary combustion chamber 45. Adjusting the first flow rate of secondary air 21 entrained into combustion flame 20, within primary combustion chamber 45, can affect the amount of secondary air 21 which is necessarily drawn into secondary combustion chamber 55. In one preferred embodiment according to this invention, peripheral gap 43 completely surrounds burner tube 30. In another preferred embodiment according to this invention, an edge of first wall 41 which forms peripheral gap 43 is continuously spaced at a distance from outer surface 31 of burner tube 30.

Inlet portion 33 of burner tube 30 is in communication with primary air supply 18 and fuel supply 16. Exit plane 34 of burner tube 30 is preferably but not necessarily positioned within primary combustion chamber 45.

Second opening 52 is preferably in communication with primary combustion chamber 45 and secondary combustion chamber 55. In one preferred embodiment according to this invention, a central longitudinal axis of second opening 52 is aligned with a central longitudinal axis of burner tube 30. As shown in FIG. 1, in a longitudinal direction of burner tube 30 and in the downstream direction, second opening 52 is positioned at a distance with respect to exit plane 34 of burner tube 30. In the downstream direction, inlet plane 61 of exhaust tube 60 is preferably positioned at a distance from exit plane 54 of second opening 52.

Figure 3:
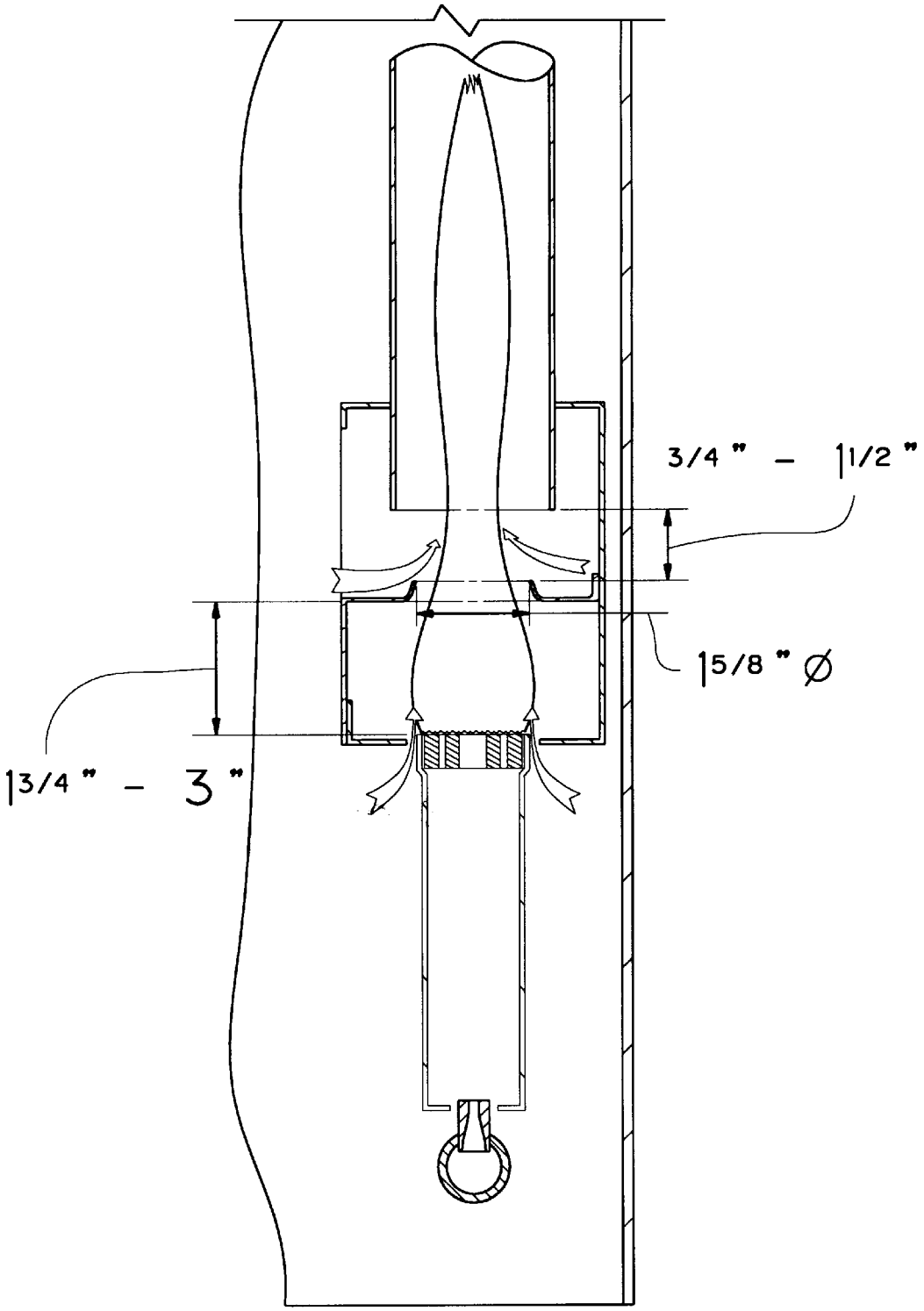
FIG. 3 is a partial cross-sectional view taken along a longitudinal axis of a burner tube and an exhaust tube of a burner apparatus with preferred dimensions, according to another preferred embodiment of this invention.

FIG. 3 shows critical dimensions of an apparatus according to one preferred embodiment of this invention. It is apparent that other suitable dimensions can be used depending upon desired flow rates and capacities. In one preferred embodiment of this invention, the approximate proportional dimensions of various components or elements labeled can be enlarged or downsized, again depending upon the particular flow rates and capacities.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

What is claimed is:

1. A method for reducing emissions in combustion products of continuous combustion, the method comprising the steps of:

introducing primary oxidant and fuel into a burner tube and discharging a fuel/oxidant mixture at a tube exit plane of the burner tube;

combusting the fuel/oxidant mixture downstream, with respect to a direction of flow through the burner tube, of the tube exit plane and forming a combustion flame within a primary combustion chamber;

passing a first flow rate of secondary oxidant through a peripheral gap between the burner tube and a first wall forming at least a portion of the primary combustion chamber and drawing the first flow rate of secondary oxidant into the combustion flame;

directing the combustion flame through a swaged orifice within a second wall forming at least a portion of a secondary combustion chamber wherein in the downstream direction the swaged orifice is positioned at a distance with respect to the tube exit plane;

discharging the combustion flame through an orifice exit plane of the swaged orifice into the secondary combustion chamber;

drawing a second flow rate of the secondary oxidant through a secondary oxidant supply forming a sheath around the combustion flame within the secondary combustion chamber; and discharging the combustion flame from the secondary combustion chamber through an exhaust tube.

2. A method according to claim 1 wherein the fuel and the primary oxidant are introduced in proportional flow rates so that the fuel/oxidant mixture is fuel-rich when discharged from the tube exit plane of the burner tube.

3. A method according to claim 2 wherein the fuel-rich fuel/oxidant mixture incompletely burns all of the fuel in the primary combustion chamber.

4. A method according to claim 1 wherein the first flow rate of the secondary oxidant and the second flow rate of the secondary oxidant are added to the primary combustion chamber and the secondary combustion chamber in sufficient amounts to completely burn the fuel.

5. A method according to claim 1 wherein the peripheral gap through which the first flow rate of the secondary oxidant is drawn is an annular gap that completely surrounds the burner tube and an outer surface of the burner tube is continuously spaced at a distance from the first wall.

6. A method according to claim 1 wherein an area of the peripheral gap is varied as a function of a desired magnitude of the first flow rate of the secondary oxidant.

7. A method according to claim 1 wherein the combustion flame passes through the swaged orifice in the downstream direction and the swaged orifice converges in the downstream direction.

8. A method according to claim 1 wherein the secondary oxidant supply is in communication with the secondary combustion chamber.

9. A method according to claim 1 wherein the secondary oxidant supply comprises an ambient surrounding at least one of the first wall and the second wall.

10. A method according to claim 1 wherein a ratio of the first flow rate divided by the second flow rate is less than 1.0.

11. A method according to claim 1 wherein the first flow rate divided by the second flow rate is in a range of approximately 0.01 to approximately 0.20.

12. A method according to claim 1 wherein the primary oxidant and the fuel are mixed in the burner tube which comprises a converging-diverging nozzle.

13. A method according to claim 1 wherein the primary oxidant and the fuel are mixed in the burner tube which forms an inshot burner.

14. A method according to claim 1 wherein the second flow rate of the secondary oxidant is drawn into the secondary combustion chamber by the combustion flame.

15. An apparatus for reducing emissions in combustion products of continuous combustion, the apparatus comprising:

a first housing forming a primary combustion chamber wherein a fuel and oxidant react to form a combustion flame, a second housing forming a secondary combustion chamber in communication with a secondary oxidant supply;

a burner tube mounted with respect to said first housing, said first housing having a first wall, an inlet portion of said burner tube in communication with a primary oxidant supply and a fuel supply, a tube exit plane of said burner tube positioned within said primary combustion chamber, said first wall having a first opening in communication with said primary combustion chamber and the secondary oxidant supply, said burner tube mounted within said first opening and said first opening forming a peripheral gap between said burner tube and said first wall;

a swaged orifice positioned between and in communication with said primary combustion chamber and said secondary combustion chamber and wherethrough the combustion flame is directed, said swaged orifice longitudinally aligned with said burner tube, in a longitudinal direction of said burner tube and in a downstream direction of a fuel and a secondary oxidant flowing through said burner tube an inlet plane of said swaged orifice positioned at a distance with respect to said tube exit plane;

means for drawing a flow of secondary oxidant into said secondary combustion chamber to form a sheath around the combustion flame; and an exhaust tube mounted with respect to said second housing, and said exhaust tube in communication with said secondary combustion chamber.

16. An apparatus according to claim 15 wherein said peripheral gap is an annular gap that completely surrounds said burner tube and an outer surface of said burner tube is spaced at a distance from said first wall.

17. An apparatus according to claim 15 wherein said swaged orifice converges in said downstream direction.

18. An apparatus according to claim 15 wherein a second wall of said second housing has a second opening in communication with said secondary oxidant supply.

19. An apparatus according to claim 15 wherein said exhaust tube is longitudinally aligned with said swaged orifice.

20. An apparatus according to claim 15 wherein in said downstream direction an exhaust tube inlet plane of said exhaust tube is positioned at a second distance from an orifice exit plane of said swaged orifice.

21. An apparatus according to claim 15 wherein said burner tube comprises an inshot burner.

* * * * *